US010487618B2

(12) United States Patent
Budde

(10) Patent No.: US 10,487,618 B2
(45) Date of Patent: Nov. 26, 2019

(54) SYSTEM AND METHOD FOR SEALING A WELLBORE

(71) Applicant: Weatherford Netherlands, B.V., Den Helder (NL)

(72) Inventor: Marcel Budde, Vlaardingen (NL)

(73) Assignee: WEATHERFORD NETHERLANDS, B.V., Dan Helder (NL)

( * ) Notice: Subject to any disclaimer, the term of this patent is extended or adjusted under 35 U.S.C. 154(b) by 495 days.

(21) Appl. No.: 14/510,984

(22) Filed: Oct. 9, 2014

(65) Prior Publication Data

US 2015/0101801 A1 Apr. 16, 2015

Related U.S. Application Data

(60) Provisional application No. 61/890,083, filed on Oct. 11, 2013.

(51) Int. Cl.

| | |
|---|---|
| ***E21B 33/13*** | (2006.01) |
| ***E21B 47/06*** | (2012.01) |
| ***E21B 23/02*** | (2006.01) |
| ***E21B 34/10*** | (2006.01) |

(Continued)

(52) U.S. Cl.

CPC ..... *E21B 33/13* (2013.01); *E21B 23/02* (2013.01); *E21B 33/14* (2013.01); *E21B 33/16* (2013.01); *E21B 34/10* (2013.01); *E21B 47/06* (2013.01)

(58) Field of Classification Search

CPC ..... E21B 47/06; E21B 23/02; E21B 33/05; E21B 33/13; E21B 33/14; E21B 33/16; E21B 33/124; E21B 34/10

See application file for complete search history.

(56) References Cited

U.S. PATENT DOCUMENTS

| | | | |
|---|---|---|---|
| 3,159,219 | A | 12/1964 | Scott |
| 4,589,495 | A | 5/1986 | Langer et al. |
| 5,553,667 | A | 9/1996 | Budde et al. |

(Continued)

FOREIGN PATENT DOCUMENTS

| | | | |
|---|---|---|---|
| RU | 874984 | A1 | 10/1981 |
| RU | 1640369 | A1 | 4/1991 |

OTHER PUBLICATIONS

Collins English Dictionary https://www.collinsdictionary.com/dictionary/english/engaged Accessed May 28, 2018 (Year: 2018).*

(Continued)

*Primary Examiner* — David Carroll

(74) *Attorney, Agent, or Firm* — Patterson + Sheridan, LLP

(57) ABSTRACT

A method of pressure testing a wellbore during a cementing operation includes positioning a tubular within a wellbore, the tubular including a collar assembly at a distal end of the tubular; urging cement through the collar assembly using a plug, the plug including a releasable sealing member; releasing the sealing member from the plug; sealing the collar assembly using the sealing member; and pressurizing the tubular to a predetermined test pressure and holding the predetermined test pressure for a predetermined time period. In another embodiment, a cementing plug for use with a collar assembly includes a plug body having a bore; and a releasable sealing member coupled to the bore, wherein sealing member is configured to engage and seal the collar assembly, after release.

22 Claims, 6 Drawing Sheets

(51) Int. Cl.
*E21B 33/14* (2006.01)
*E21B 33/16* (2006.01)

(56) References Cited

U.S. PATENT DOCUMENTS 5,787,979 A 8/1998 Giroux et al.
5,813,457 A 9/1998 Giroux et al.
6,009,944 A 1/2000 Gudmestad
6,244,350 B1 6/2001 Gudmestad et al.
6,309,002 B1 * 10/2001 Bouligny ..... E21B 19/07 294/86.15
6,311,775 B1 11/2001 Allamon et al.
6,419,015 B1 7/2002 Budde et al.
6,799,638 B2 10/2004 Butterfield, Jr.
6,802,372 B2 10/2004 Budde
7,182,135 B2 2/2007 Szarka
8,201,634 B2 6/2012 Laurel et al.
8,327,937 B2 12/2012 Giem et al.
8,789,582 B2 7/2014 Rondeau et al.
9,297,230 B2 3/2016 Stair
9,303,482 B2 4/2016 Hall et al.
2003/0230405 A1 12/2003 Allamon et al.
2005/0103492 A1 * 5/2005 Szarka ..... E21B 33/16 166/265
2008/0251253 A1 10/2008 Lumbye
2010/0294503 A1 * 11/2010 Laurel ..... E21B 33/16 166/335
2012/0031614 A1 2/2012 Rondeau et al.
2013/0112410 A1 5/2013 Szarka et al.
2014/0102723 A1 * 4/2014 Stair ..... E21B 23/08 166/386

OTHER PUBLICATIONS

30 CFR § 250.1609—Pressure testing of casing. (Year: 2013).*
PCT International Search Report and Written Opinion dated Apr. 9, 2015, for International Application No. PCT/US2014/059962.
Canadian Office Action dated Nov. 16, 2016, for Canadian Patent Application 2,925,009.

* cited by examiner

SYSTEM AND METHOD FOR SEALING A WELLBORE

BACKGROUND OF THE INVENTION

Field of the Invention

Embodiments of the present invention generally relate to a system and method of sealing a tubular during a cementing operation. More particularly, the present invention relates to a releasable plug that may be released from a device, such as a cement plug, into a float assembly, which in turn, seals a casing from an annulus of a wellbore.

Description of the Related Art

A wellbore is formed by using a drill bit on a drill string to drill through a geological formation. After drilling through the formation to a predetermined length or depth, the drill string and drill bit are removed, and the wellbore is lined with a string of casing. The space between the outer diameter of the casing and the wellbore is referred to as an annulus. In order to prevent the casing from moving within the wellbore, the annulus is filled with cement using a cementing operation. In addition to preventing the casing from moving within the wellbore, the cemented annulus also provides for a stronger wellbore for facilitation of hydrocarbon production.

When the casing is sent downhole, the casing is typically filled with a fluid, such as drilling mud, and the fluid is maintained at a predetermined pressure. The fluid within the casing ensures that the casing does not collapse within the wellbore. A bottom end of the casing usually includes a float assembly, such as a float collar or a float shoe. The float assembly includes one or more unidirectional check valves that allow fluid to pass from the casing out to the annulus, but prevents fluid from entering from the annulus into the casing. An upper end of the float assembly may also include a receptacle for receiving a device, such as a cement plug.

During a cementing operation, it is preferred that the cement is isolated or separated from any other fluid within the casing. When fluids such as drilling mud mix with cement, it can cause the cement to sour and fail when it sets. Accordingly, a first plug is usually sent down in front of the cement during a cementing operation. The first plug includes one or more fins around its circumference which acts to separate the drilling fluid below the first plug from the cement above the first plug. The fins also clean the inner walls of the casing as the first plug descends into the casing. Because the first plug provides both a separation and cleaning function, the outer diameter of the first plug is approximately equal to the inner diameter of the casing. The first plug includes a bore through a center longitudinal portion of the first plug. The first plug also includes a rupture membrane, such as rupture assembly, radially positioned across the bore, which prevents the drilling fluid below the first plug from comingling with the cement above the first plug. As the first plug descends into the casing, the drilling fluid moves through the float assembly and out into the annulus. The check valve within the float assembly prevents the drilling fluid from moving back into the casing.

Once the first plug reaches the float assembly, hydrostatic pressure builds on the upper side of the rupture membrane. Once the first plug reaches a rupture pressure, the rupture membrane ruptures, and the cement flows through the bore of the first plug, through the float assembly, and into the annulus. The check valve within the float assembly prevents the cement from moving back into the casing.

A second plug is usually sent down the casing behind the cement, and the second plug is usually pushed downward with drilling fluid. The second plug includes one or more fins that separate the cement below the second plug from the drilling fluid above the second plug. The fins also clean the sidewalls of the casing as the second plug descends down the casing. The second plug generally does not include a bore within a center portion. As the second plug is pushed through the casing, the cement is squeezed out of the float assembly into the annulus until the second plug reaches the first plug. In some embodiments, the first plug and second plug are locked together. In the prior art, at least one of the first or second plugs form a seal within the casing, which prevents fluid from moving past the first or second plugs. Once the wellbore is sealed, the cement is given time to cure and set up as a constant pressure is maintained within the casing. Before or after the cement has cured, the casing is pressure tested by injecting additional drilling fluid into the casing up to a casing operational pressure, which is then held for a certain time period in order to establish the back pressure capabilities of the casing.

The length and depth of oil and gas wells continues to increase, which results in high temperatures and high pressures within the casing. As a result, the casing required to line deeper oil and gas wells includes an increased diameter. In order to perform cementing operations in the extended diameter casings, the plugs used in cementing operations must also have an increased diameter, and must also be comprised of materials that may withstand high temperature and high pressure. Accordingly, the materials required for larger diameter plugs are often expensive. In addition, an adequate seal in the wellbore is required following a cementing operation, and obtaining a seal with extended diameter plugs is difficult to achieve. Because sealing the casing is difficult to achieve, there is difficulty in pressure testing the cemented casing to prove up its mechanical integrity.

Therefore, there is a need for a more effective system and method for sealing a wellbore during cementing operations.

SUMMARY OF THE INVENTION

In one embodiment, a method of using a plug with a collar assembly includes positioning a releasable sealing member in a first position, wherein the releasable sealing member is configured to seal against the plug; and positioning the releasable sealing member in a second position, wherein the releasable sealing member is displaced with respect to the plug and seals against the collar assembly.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to systems and methods of sealing a wellbore during a cementing operation. After cement is pumped down a casing in a cementing operation, a cement plug including a sealing member travels downhole. When a predetermined pressure above the cement plug is reached, the sealing member is at least partially released from the cement plug. The sealing member travels to a float assembly located in a bottom portion of the casing, and the sealing member seats itself within a receptacle positioned in the float assembly. The sealing member seated within the receptacle seals the casing from fluid in the annulus of the wellbore, and following an appropriate cement cure period, the casing may be pressure tested within the wellbore.

Figure 1:
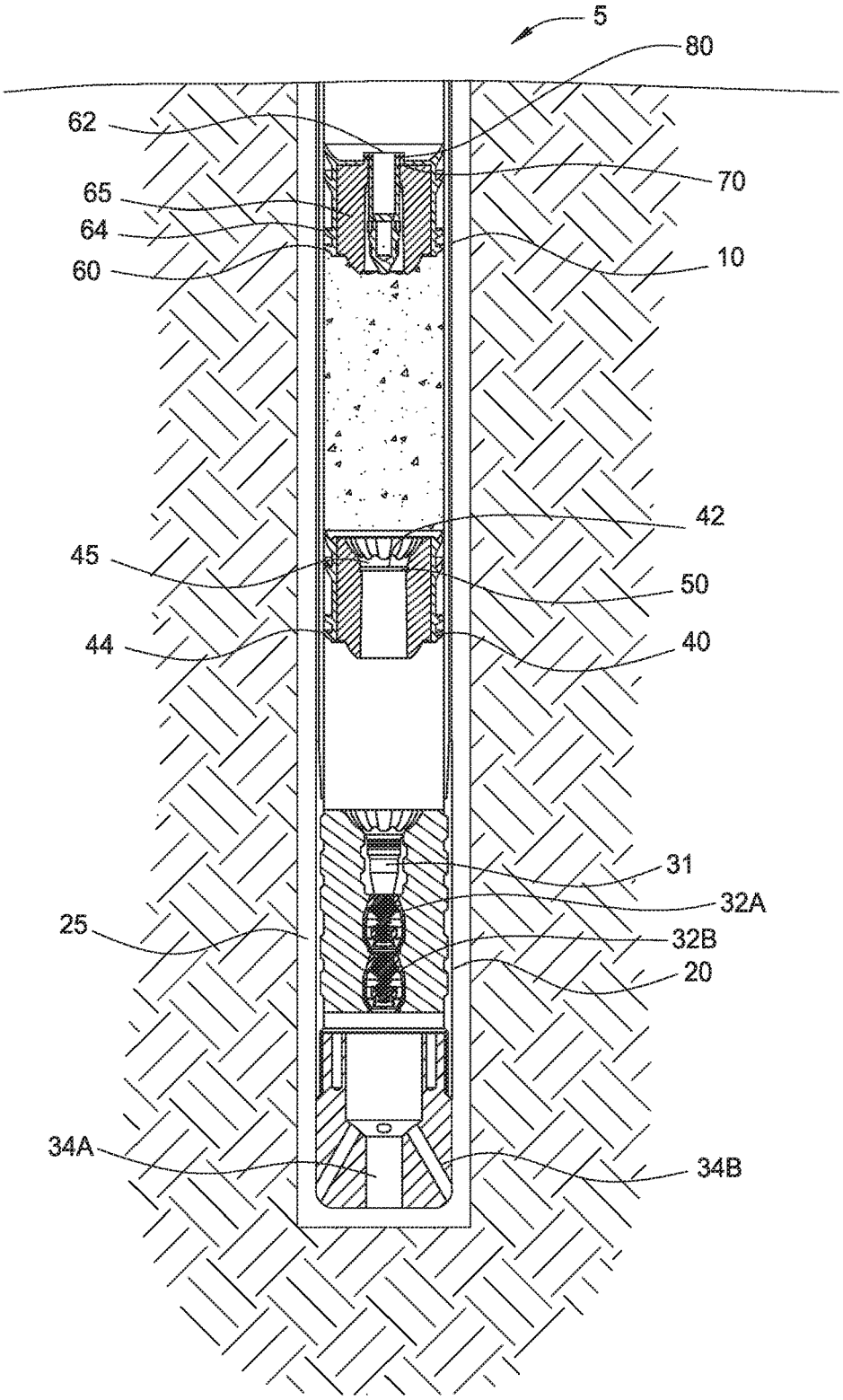
FIG. 1 illustrates an overview of an embodiment of a system for sealing a wellbore.

FIG. 1 illustrates an embodiment of a system for a cementing operation. A casing 10 has been lowered into a wellbore 5 and includes a collar assembly such as a float assembly 20 disposed at a lower end of the casing 10. The float assembly 20 includes a bore 31 and may include one or more valves 32A,B for controlling fluid flow through the bore 31. In one embodiment, the valves 32A,B are one way valves configured to allow fluid to flow through the bore 31 and out of the casing 10, but prevent fluid re-entering the casing 10 through the bore 31. The fluid may flow out of the casing 10 through one or more ports 34A, B at the bottom of the casing 10. In another embodiment, the collar assembly may be a landing collar, which may include a bore without a valve.

As shown, a first plug 40 and a second plug 60 are used to separate the cement from fluid in front of the cement and the fluid behind the cement. The fluid in front may be a drilling fluid and the fluid behind may be a push fluid such as a drilling fluid. In some applications, a spacer fluid may be disposed between the cement and the fluid in front of the cement, disposed between the cement and the push fluid behind the cement, or both. In one embodiment, the first plug 40 may be a cement plug having a bore 45 through the first plug 40, and a rupture assembly 50 positioned within the bore 45. The rupture assembly 50 is configured to break at a predetermined pressure. The first plug 40 may include one or more fins 44 circumferentially positioned on its exterior surface for sealingly contacting the wall of the casing 10. The fins 44 act as a barrier to prevent comingling of fluids from above and below the plug 40. The fins 44 may clean the wall of the casing 10 as the plug 40 descends in the casing 10. It is contemplated the first plug 40 may be any suitable cement plug known to a person of ordinary skill in the art.

When the first plug 40 reaches the float assembly 20, the rupture assembly 50 located in the first plug 40 ruptures when hydrostatic pressure acting on an upper portion 42 of the rupture assembly 50 reaches a rupture pressure. The rupture of the rupture assembly 50 thereby opens the first plug bore 45 to allow the cement to flow through the first plug 40, through the float assembly 20, and out to an annulus 25.

The second plug 60, equipped with a sealing member 70, is positioned above the cement and descends into the wellbore until the second plug 60 reaches the first plug 40. The second plug 60 includes one or more fins 64 that separate the cement below the second plug from the drilling fluid above the second plug. The fins 64 also clean the sidewalls of the casing 10 as the second plug 60 descends down the casing. The sealing member 70 is held in place in the second plug 60 by a shearing mechanism 80. After the second plug 60 reaches the first plug 40, hydrostatic pressure acting on an upper portion 62 of the sealing member 70 is increased until the shearing mechanism 80 shears and the sealing member 70 is released. After the sealing member 70 is released from the second plug 60, the sealing member 70 travels through the second and first plugs 60, 40, and into a receptacle 30 in the float assembly 20. The sealing member 70 seals the float assembly 20 and the casing 10 from the annulus 25 of the wellbore 5. Thereafter, the tubular 10 may be pressure tested.

While FIG. 1 and FIGS. 2A-4C (which will be described hereafter) illustrate two plugs 40, 60, it is contemplated that more than 2 plugs 40, 60 may be used in conjunction with the system and method of the present invention, with at least one of the plugs including a sealing member 70.

Figure 2A:
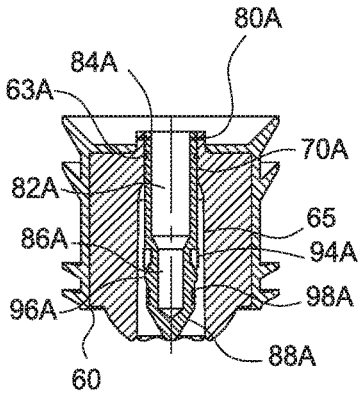
FIG. 2A is cross sectional view of an embodiment of a sealing member that is housed within a second plug.

FIG. 2A is a cross sectional view of an embodiment of a sealing member 70A releasably attached to a second plug 60, and FIGS. 2B-2E are cross sectional views of various stages of an exemplary cementing operation using the second plug 60 and sealing member 70A shown in FIG. 2A. The sealing member 70A is selectively releasable from the second plug 60. In one embodiment, the sealing member 70A is released using fluid pressure. As shown, the sealing member 70A is attached to a bore 65 of the second plug 60. A seal ring 63A may be disposed around the sealing member 70A to prevent fluid communication through the bore 65. For example, the seal ring 63A prevents fluid communication through the bore 65 before the sealing member 70A is released from the second plug 60. The sealing member 70A may have a cylindrical body and may include a bore 82A through a longitudinal portion of the body that extends from an upper portion 84A of the sealing member 70A. The bore 82A may be open to the casing bore and may extend to a point less than the entire length of the sealing member 70A. Optionally, the sealing member 70A may include a second bore 86A that is countersunk from the bore 82A such that a diameter of the second bore 86A is less than a diameter of the bore 82A, as shown in FIG. 2A. Also optionally, the sealing member 70A may include a tapered section at a lower end of the first or second bores 82A, 86A. As shown in this embodiment, the lower end of the sealing member 70A has a conical section 88A to facilitate movement through the plugs 40, 60.

The sealing member 70A is configured to mate with the receptacle 30 in the float assembly 20. In one embodiment, the sealing member 70A includes an external diameter that is approximately equivalent to an internal diameter of the receptacle 30. The sealing member 70A may optionally include a lock ring 94A on the external perimeter, which engages a groove 38 of the receptacle 30. The sealing member 70A may also include a shoulder 96A positioned below the lock ring 94A that engages a seat on the receptacle 30, to help prevent the sealing member 70A from axial movement. Additionally, the sealing member 70A includes one or more seals 98A, such as o-rings, that prevent fluid communication through the bore 65 of the second plug 60.

A shear mechanism 80A holds the sealing member 70A in position within the second plug bore 65 as the second plug 60 descends in the tubular 10. Suitable shear mechanism 80A may include one or more shear pins, shear screws, or any other shearing device that may shear upon reaching a predetermined shear pressure. It is also contemplated that the shear mechanism 80A may constitute a frangible device that may rupture upon reaching a predetermined rupture pressure.

Figure 2B:
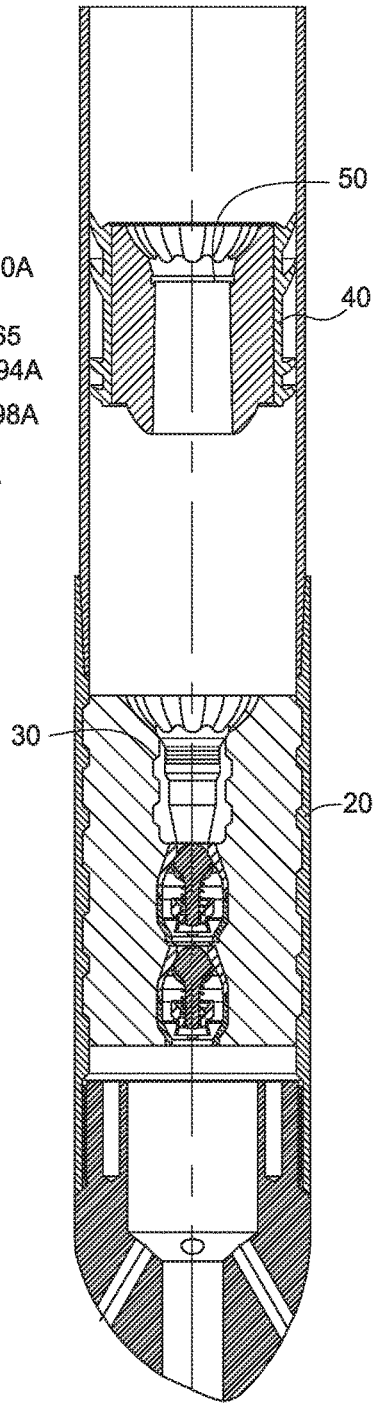
FIG. 2B is a cross sectional view of an embodiment of a system for sealing a wellbore during a cement operation at one point in time. In this view, a first plug pushes drilling fluid through a float assembly, and cement is positioned above the first plug.
Figure 2C:
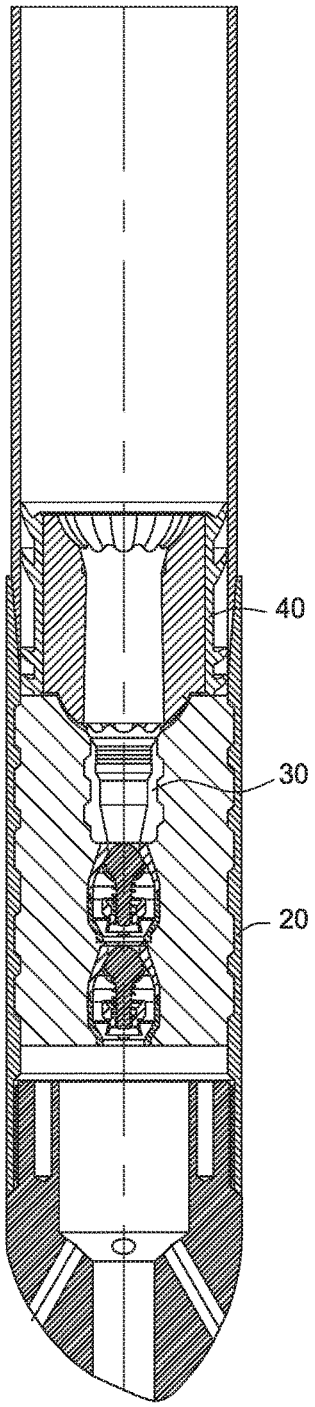
FIG. 2C is a cross sectional view of the system of FIG. 2B during a cement operation at another point in time. In this view, the first plug is seated on the float assembly and cement flows through the float assembly.
Figure 2D:
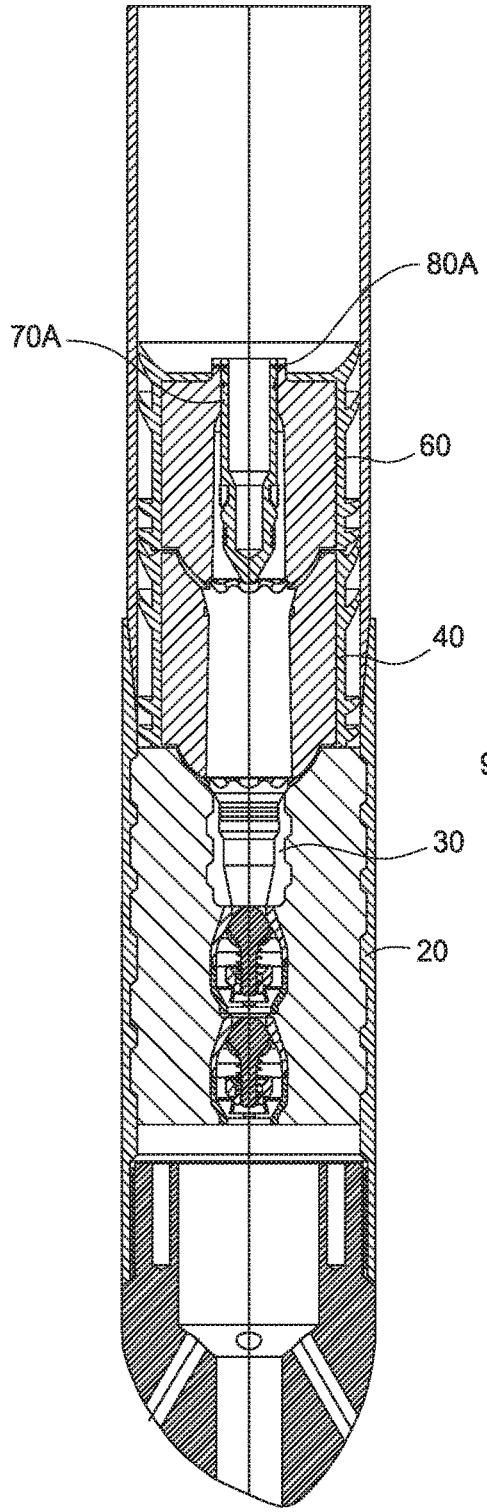
FIG. 2D is a cross sectional view of the system of FIG. 2B during a cement operation at another point in time. In this view, the second plug has pushed the cement through the first plug, and the second plug is seated on the first plug.
Figure 2E:
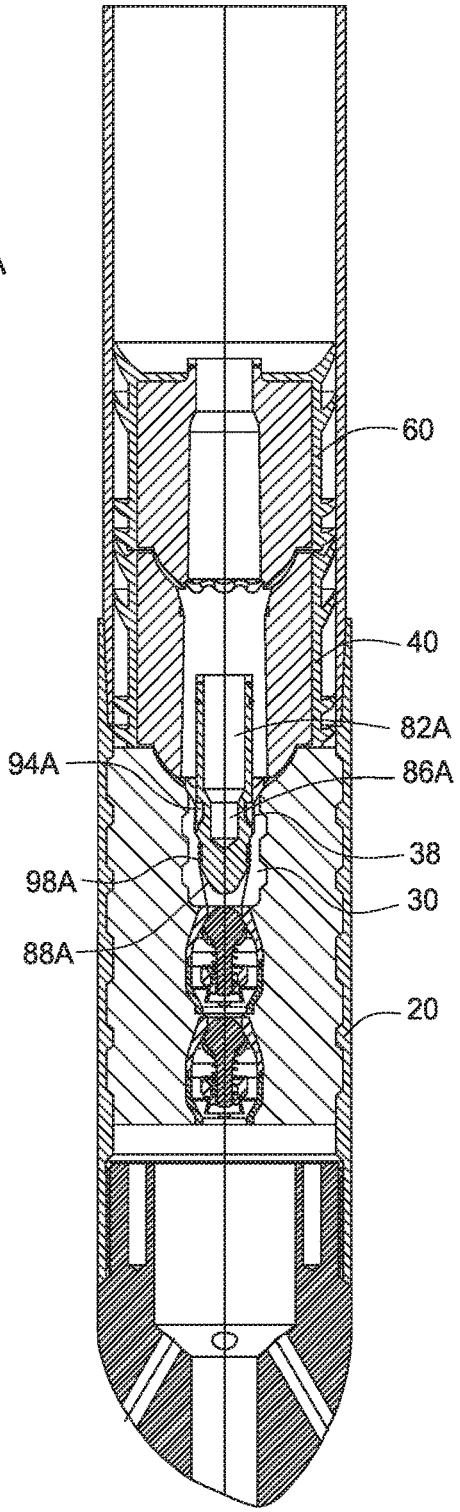
FIG. 2E is a cross sectional view of the system of FIG. 2B during a cement operation at another point in time. In this view, the sealing member shown in FIG. 2A has been released from the second plug, and the sealing member is positioned within the float assembly.

As shown in FIG. 2B, and as discussed with respect to FIG. 1, during a cementing operation, the first plug 40 is sent downhole preceding the cement and behind a drilling fluid. After the first plug 40 reaches the float assembly 20, as shown in FIG. 2C, hydrostatic pressure builds on the rupture assembly 50 (shown in FIG. 2B) until it reaches the predetermined rupture pressure. After the rupture assembly 50 ruptures, the cement flows through the first plug 40, through the float assembly 20, and out to the annulus. The second plug 60, which is behind the cement, travels downward until it reaches the first plug, as shown in FIG. 2D. Pressure above the second plug 60 builds until the shear mechanism 80A shears, thereby releasing the sealing member 70A from the second plug 60. The sealing member 70A travels through the first plug 40 and lands in the receptacle 30, as shown in FIG. 2E. The conical section 88A of the sealing member 70A aids in positioning the sealing member 70A within the receptacle 30, and the lock ring 94A of the sealing member 70A engages the groove 38 of the receptacle 30, thereby preventing the sealing member 70A from axial movement. The seals 98A prevent fluid communication through the bore 31 of the float assembly 20.

Before or after the cement has cured, a bump pressure test may be conducted on the tubular 10. Drilling fluid may be pumped into the tubular until a desired test pressure is established. Because the fluid is allowed to flow through the bores 65, 45 of the second and first plugs 60, 40, respectively, the fluid pressure is directed to the sealing member 70A. Accordingly, because the forces are acting on the sealing member 70A, the first and second plugs 40, 60 are no longer required to provide a surface seal in order to establish a bump pressure test. Therefore, the first and second plugs 40, 60 may need not to be designed to withstand the pressure test and may function to only separate fluids during the cementation process. Although only a single first plug 40 has been described herein, it is contemplated any suitable number of plugs not equipped with a releasable sealing member (e.g., the first plug) may be released into the wellbore prior to the release of the plug equipped with the sealing member (e.g., the second plug). In one example, a multiple plug system may be used to separate several types of fluids that may be required for certain operations. In another example, the multiple plug system may be used for chemical washes or with other required fluids for cementation operations. In yet another example, the multiple plug system may be used where calibration plugs are used to confirm displacement and volumes in the casing.

Figure 3A:
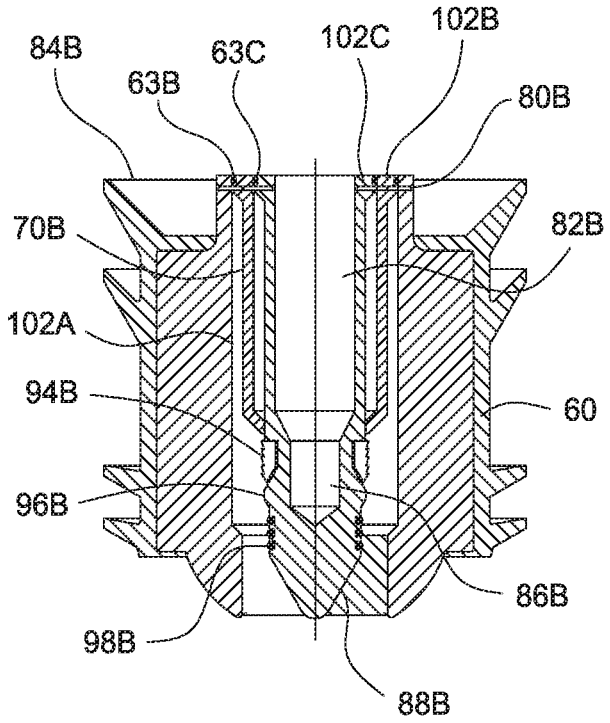
FIG. 3A is a cross sectional view of another embodiment of a sealing member that is housed within the second plug.
Figure 3B:
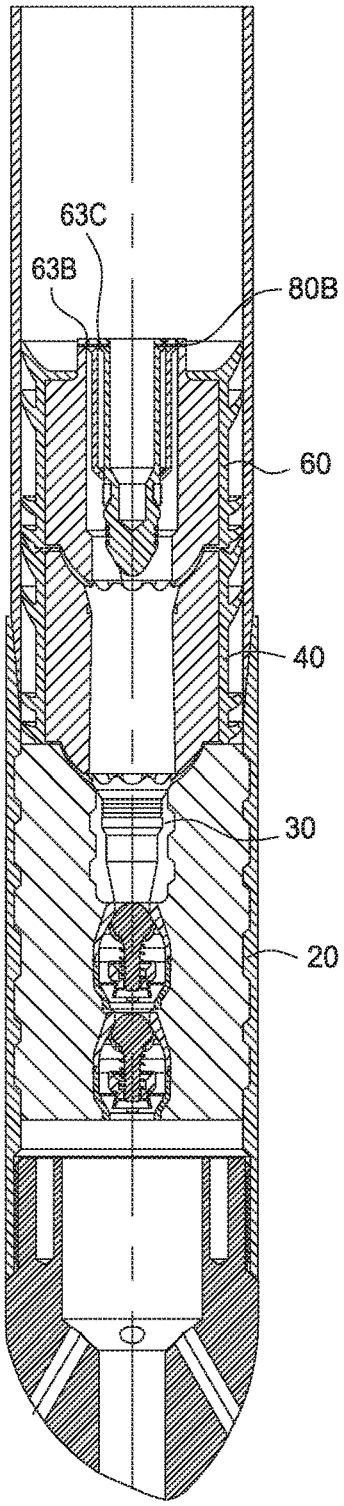
FIG. 3B is a cross sectional view of an embodiment of a system for sealing a wellbore during a cement operation at one point in time. In this view, the second plug, including the sealing member shown in FIG. 3A, has pushed the cement through the first plug, and the second plug is seated on the first plug.
Figure 3C:
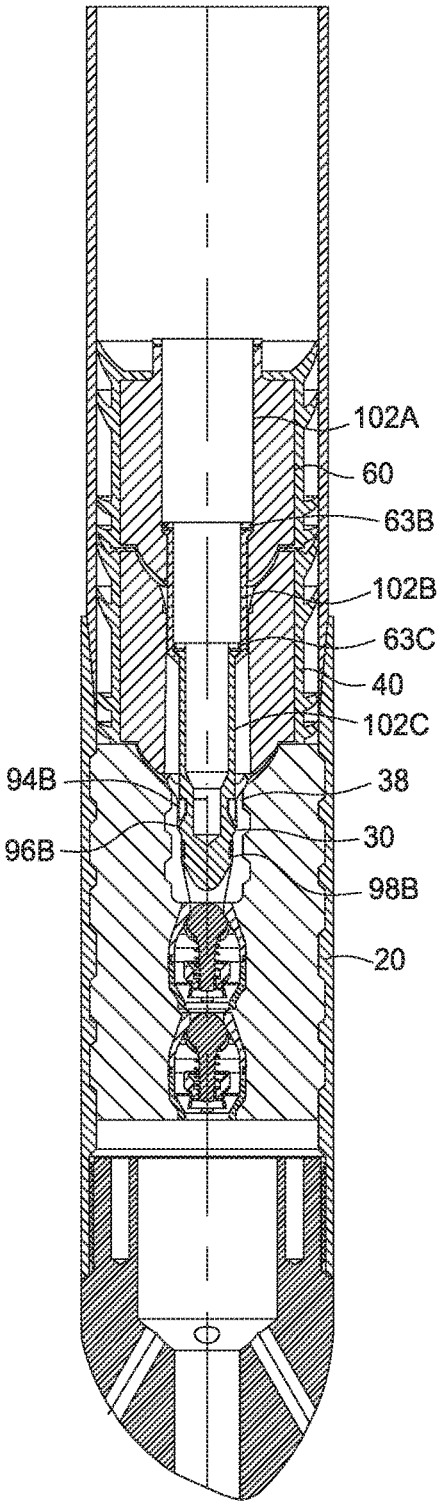
FIG. 3C is a cross sectional view of the system of FIG. 3B during a cement operation at another point in time. In this view, the sealing member shown in FIG. 3A has been released from the second plug, and the sealing member is positioned within the float assembly.

FIG. 3A is a cross sectional view of another embodiment of a sealing member 70B that is disposed within the second plug 60, and FIGS. 3B-3C are cross sectional views of various stages of an exemplary cementing operation. The sealing member 70B in FIG. 3A is an extendable sealing member 70B having a telescoping portion that may release from the second plug 60 and telescope into the receptacle 30. The second plug 60 of FIG. 3A may function in a similar manner as the second plug 60 shown in FIG. 2A-2E, with the exception of the sealing member 70B. As such, the cementing operation described above is almost identical.

Referring to FIG. 3A, the sealing member 70B includes a longitudinal bore 82B that extends from an upper portion 84B of the sealing member 70B to a point less than the entire length of the sealing member 70B. Optionally, the sealing member 70B may include a smaller second bore 86B that is countersunk from the bore 82B. Also optionally, the sealing member 70B may include a tapered section at a lower end of the first or second bores 82B, 86B. As shown in this embodiment, the lower end of the sealing member 70B has a conical section 88B to facilitate movement through the plugs 40, 60.

The sealing member 70B includes a plurality of body sections 102C, 102B, each of which having a different outer diameter. The body sections 102C, 102B are positioned co-axially in a second plug bore 102A and can telescope from one another. For example, as shown in FIGS. 3A-3C, the sealing member 70B includes a first section 102C and a second section 102B. Seals 63B, 63C, such as o-rings, may be disposed on the first and second sections 102B, 102C to seal the exterior of the first and second sections 102B, 102C. For example, the seals 63B, 63C prevent fluid communication through the bore 102A of the second plug 60 as the second plug 60 descends in the tubular 10. The seals 63B, 63C may also be configured to continue to seal the exterior of the first and sections 102B, 102C after the first and second sections 102B, 102C are released from the second plug 60. It is also contemplated that the sealing member 70B could have three or more sections 102 with respective seals 63 thereon. As shown in FIGS. 3A-3C, the first section 102C has an outer diameter that is smaller than the outer diameter of the second section 102B. The outer diameter of the first section 102C is configured to fit within the internal diameter of the receptacle 30. A shear mechanism 80B holds the first and second sections 102C, 102B of the sealing member 70B in position within the second plug bore 102A as the second plug 60 descends in the tubular 10. The shear mechanism 80B may include one or more shear pins, shear screws, or any other shearing device that may shear upon reaching a predetermined shear device. It is also contemplated that the shear mechanism 80B may also constitute a frangible device that may rupture upon reaching a predetermined rupture pressure. When the shear mechanism 80B shears, the first section 102C and the second section 102B are released from the second plug 60, but remain coupled to each other. The first section 102C may lower into engagement with the receptacle 30.

The sealing member 70B may include a lock ring 94B on the external diameter of the first section 102C, which locks into a groove 38 of the receptacle 30. The sealing member 70B may also include a shoulder 96B positioned below the lock ring 94B that engages a seat on the receptacle 30, to help prevent the sealing member 70B from axial movement. Additionally, the sealing member 70B includes one or more seals 98B, such as o-rings, that prevent fluid communication through the bore of the float assembly 20.

During a cementing operation, the first plug 40 is sent downhole preceding the cement. After the first plug 40 lands on the float assembly 20, pressure is increased to break the rupture assembly 50. Thereafter, cement behind the first plug 40 flows through the first plug 40, through the float assembly 20, and out to the annulus.

As shown in FIG. 3B, the second plug 60 follows the cement until it reaches the first plug 40. The seals 63B, 63C prevent fluid communication through the bore 102A of the second plug 60 as the second plug 60 descends in the tubular 10. Pressure is increased above the second plug 60 to a predetermined pressure sufficient to shear the shear mechanism 80B retaining the sealing member 70B, thereby releasing the first and second sections 102C, 102B of the sealing member 70B. The second section 102B may land on a shoulder in the second plug 60, and the first section 102C may continue downward until it seats on the receptacle 30, as shown in FIG. 3C. The conical section 88B of the sealing member 70B aids in positioning the sealing member 70B within the receptacle 30. The lock ring 94B of the sealing member 70B locks the second plug 60 to the receptacle 30, and prevents the plug 60 from axial movement. In one embodiment, the seals 63B, 63C do not continue to seal the exterior of the first and second sections 102B, 102C after release. Accordingly, the seals 98B prevent fluid communication through the bore of the float assembly 20. In another embodiment, the seals 63B. 63C continue to seal the exterior of the first and sections 102B, 102C after release. Accordingly, the seals 63B, 63C prevent fluid communication through the bore of the float assembly 20 and the seals 98B provide a secondary seal. Thereafter, a bump test may be performed as discussed above.

Figure 4A:
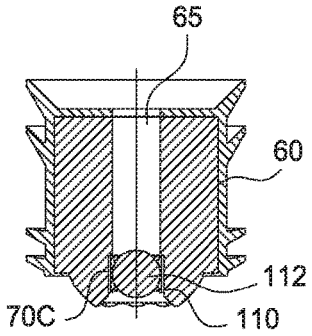
FIG. 4A is a cross sectional view of another embodiment of a sealing member that is housed within the second plug.
Figure 4B:
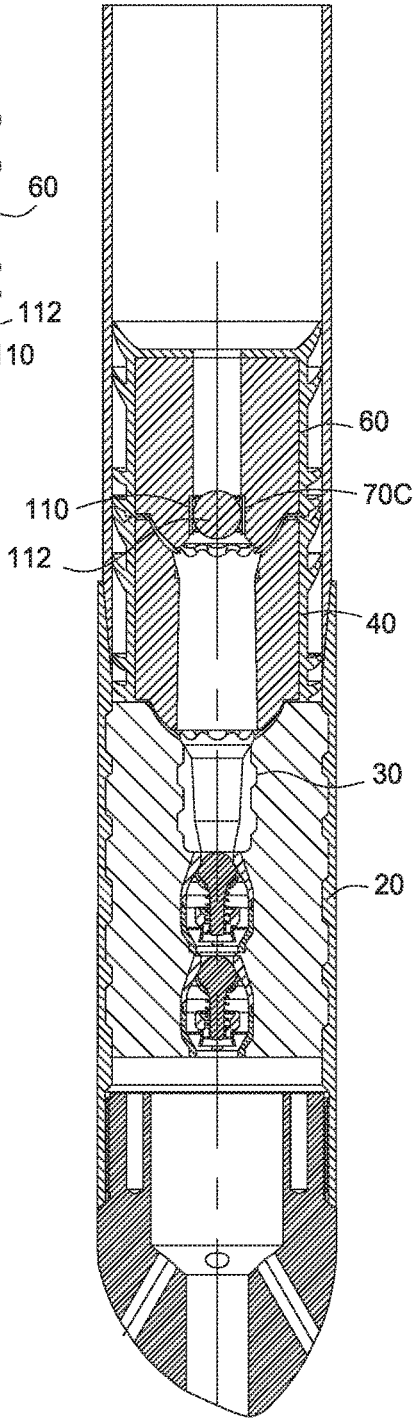
FIG. 4B is a cross sectional view of an embodiment of a system for sealing a wellbore during a cement operation at one point in time. In this view, the second plug, including the sealing member shown in FIG. 4A, has pushed the cement through the first plug, and the second plug is seated on the first plug.
Figure 4C:
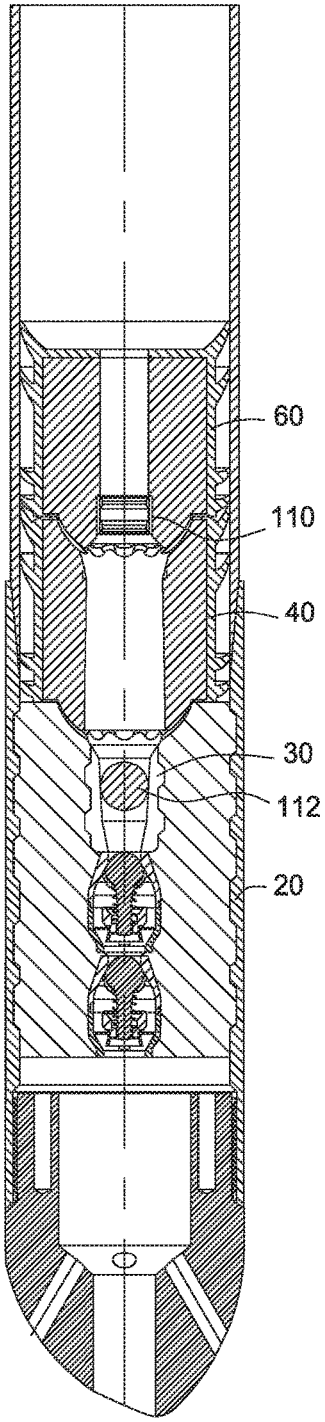
FIG. 4C is a cross sectional view of the system for sealing a wellbore during a cement operation during another point in time. In this view, the sealing member shown in FIG. 4A has been released from the second plug, and the sealing member is positioned within the float assembly.

FIG. 4A is a cross sectional view of another embodiment of a sealing member 70C that is disposed within the second plug 60, and FIGS. 4B-4C are cross sectional views of various stages of an exemplary cementing operation. The sealing member 70C in FIG. 3A is a ball plug 70C that may be selectively released from the second plug 60 into the float assembly receptacle 30. The ball plug 70C includes a ball enclosure 110 that fits within the second plug bore 65, and houses a ball 112, which prevents fluid from moving through the bore 65 of the second plug 60 as the second plug 60 travels downhole. As discussed in previous embodiments, the ball plug 70C travels with the second plug 60 downhole until the second plug 60 reaches the first plug 40. Pressure is increased until a threshold pressure is reached to release the ball 112 from the ball enclosure 110. Then the ball 112 lands in the receptacle 30, and seals the tubular 10 from the annulus 25 of the wellbore 5. Thereafter, the tubular 10 may be pressure tested, as previously discussed.

In one embodiment, a method of pressure testing a wellbore during a cementing operation includes positioning a tubular within a wellbore, the tubular including a collar assembly at a distal end of the tubular; urging cement through the collar assembly using a plug, the plug including a releasable sealing member; releasing the sealing member from the plug; sealing the collar assembly using the sealing member; and pressure testing the tubular.

In one or more of the embodiments described herein, the method also includes locking the sealing member to the collar assembly using a lock ring on the sealing member that seats within a groove in the collar assembly.

In one or more of the embodiments described herein, the method also includes urging a second plug positioned in front of the cement down the tubular, the second plug including a bore and a rupture assembly closing the bore; positioning the second plug on the collar assembly; applying pressure on the second plug until the rupture assembly is ruptured; and landing the plug on the second plug.

In one or more of the embodiments described herein, the releasable sealing member is held within the plug using a shear mechanism, and the method further includes shearing the shear mechanism to release the releasable sealing member.

In one or more of the embodiments described herein, the releasable sealing member includes a plurality of telescoping body sections.

In one or more of the embodiments described herein, the releasable sealing member includes a ball.

In another embodiment, a system for cementing a wellbore includes a tubular positioned within a wellbore, the tubular including a collar assembly disposed at a distal end of the tubular; a plug configured to land on the collar assembly; and a releasable sealing member coupled to the plug, wherein the sealing member is configured to engage and seal the collar assembly.

In one or more of the embodiments described herein, the releasable sealing member is coupled to the plug using a shear mechanism.

In one or more of the embodiments described herein, the releasable sealing member includes a lock ring that locks into a groove within the collar assembly.

In one or more of the embodiments described herein, the releasable sealing member further includes a seal that prevents fluid communication through a bore of the collar assembly.

In one or more of the embodiments described herein, the releasable sealing member includes at least two telescoping sections, the telescoping sections fastened together by a shear assembly.

In one or more of the embodiments described herein, one of the telescoping sections is released from the plug when the plug reaches a predetermined pressure, and travels to and seals the collar assembly.

In one or more of the embodiments described herein, the releasable sealing member includes a ball that seats within the collar assembly.

In one or more of the embodiments described herein, the system includes a second plug that precedes the cement and seats itself on the collar assembly, the second plug including a rupture assembly.

In one or more of the embodiments described herein, the collar assembly is a float collar or a landing collar.

In one or more of the embodiments described herein, the collar assembly includes a valve for controlling fluid flow through a bore of the collar assembly.

In another embodiment, a method of conducting a cementing operation in a wellbore includes landing a plug on a float assembly of a tubular, wherein the plug includes a releasable sealing member; applying pressure to the plug to release the sealing member from the plug; and sealing the float assembly using the sealing member.

In one or more of the embodiments described herein, the method includes urging a second plug down the tubular; and urging cement disposed between the plug and the second plug through the tubular.

In one or more of the embodiments described herein, the releasable sealing member is fastened to the plug using a shear mechanism configured to shear at a predetermined pressure.

In one or more of the embodiments described herein, the releasable sealing member includes at least a first and second telescoping section.

In another embodiment, a cementing plug for use with a collar assembly includes a plug body having a bore; and a releasable sealing member coupled to the bore, wherein sealing member is configured to engage and seal the collar assembly, after release.

In one or more of the embodiments described herein, pressure testing the tubular includes pressurizing the tubular to a predetermined test pressure and holding the predetermined test pressure for a predetermined time period.

In one or more of the embodiments described herein, the method also includes sealing the releasable sealing member against the plug.

In one or more of the embodiments described herein, the releasable sealing member includes a seal that prevents fluid communication through a bore of the plug.

In another embodiment, a method of conducting a cementing operation in a wellbore includes urging a plug down the wellbore, wherein the plug includes a releasable sealing member; landing the plug; and releasing the releasable sealing member from the plug.

In one or more of the embodiments described herein, releasing the releasable sealing member from the plug seals the releasable sealing member against a collar assembly.

In another embodiment, a method of using a plug with a collar assembly includes urging the plug towards the collar assembly, wherein a releasable sealing member is configured to seal against the plug; releasing the releasable sealing member; and sealing the releasable sealing member against the collar assembly.

In another embodiment, a method of using a plug with a collar assembly includes positioning a releasable sealing member in a first position, wherein the releasable sealing member is configured to seal against the plug; and positioning the releasable sealing member in a second position, wherein the releasable sealing member is displaced with respect to the plug and seals against the collar assembly.

While the foregoing is directed to embodiments of the present invention, other and further embodiments of the invention may be devised without departing from the basic scope thereof, and the scope thereof is determined by the claims that follow.

The invention claimed is:

1. A method of pressure testing a wellbore during a cementing operation, comprising:

positioning a tubular within a wellbore, the tubular including a collar assembly at a distal end of the tubular;

releasing a first plug within the tubular, the first plug including a bore;

urging cement through the collar assembly using a second plug, the second plug including a releasable sealing member;

releasing the releasable sealing member from the second plug;

urging the releasable sealing member downstream through the bore of the first plug;

seating the sealing member against the collar assembly and sealingly contacting the sealing member with the collar assembly to seal the releasable sealing member against the collar assembly; and pressure testing the tubular.

2. The method of claim 1, further including:

locking the releasable sealing member to the collar assembly using a lock ring on the releasable sealing member that seats within a groove in the collar assembly.

3. The method of claim 1 wherein the first plug includes a rupture assembly closing the bore and the method further includes applying pressure on the first plug until the rupture assembly is ruptured.

4. The method of claim 1, wherein the releasable sealing member is held within the second plug using a shear mechanism, and the method further includes shearing the shear mechanism to release the releasable sealing member.

5. The method of claim 1, wherein the releasable sealing member includes a ball.

6. The method of claim 1, wherein pressure testing the tubular comprises pressurizing the tubular to a predetermined test pressure and holding the predetermined test pressure for a predetermined time period.

7. The method of claim 1, wherein the collar assembly is a float collar or a landing collar.

8. The method of claim 1, wherein the sealing member is free from engagement with the first plug when the sealing member is seated against the against the collar assembly.

9. The method of claim 1, further comprising flowing fluid through the bore of the first plug after seating the sealing member against the collar assembly.

10. A system for cementing a tubular within a wellbore, comprising:

a collar including a receptacle;

a plug; and a releasable sealing member coupled to the plug, a lower end of the releasable sealing member including a conical section, wherein the receptacle of the collar is configured to receive the conical section of the releasable sealing member so the releasable sealing member seats and seals against the collar.

11. The system of claim 10, wherein the releasable sealing member is coupled to the plug using a shear mechanism.

12. The system of claim 10, further including a second plug having a lower portion configured to sit on the collar, the second plug including a rupture assembly.

13. The system of claim 10, wherein the collar is a float collar or a landing collar.

14. The system of claim 10, wherein the collar includes a valve for controlling fluid flow through a bore of the collar.

15. The system of claim 10, wherein the releasable sealing member includes a seal that prevents fluid communication through a bore of the plug.

16. The system of claim 10, wherein the releasable sealing member includes a lock ring that locks into a groove of the receptacle of the collar.

17. The system of claim 16, wherein the releasable sealing member further includes a seal that prevents fluid communication through a bore of the receptacle of the collar.

18. A method of conducting a cementing operation in a tubular within a wellbore, comprising:

landing a first plug on a float collar, the first plug having a bore;

landing a second plug on the first plug, wherein the second plug includes a releasable sealing member, a lower end of the releasable sealing member having a conical section;

applying pressure to the second plug to release the releasable sealing member from the second plug, the releasable sealing member flowing through the bore of the first plug; and sealing a float collar using the releasable sealing member, the conical section of the releasable sealing member seating against the float collar.

19. The method of claim 18, wherein the method further includes urging cement disposed between the first plug and the second plug through the tubular.

20. The method of claim 18, wherein the releasable sealing member is fastened to the second plug using a shear mechanism configured to shear at a predetermined pressure.

21. The method of claim 18, wherein the sealing member is free from engagement with the first plug when conical section of the releasable sealing member is seated against the float collar.

22. The method of claim 18, further comprising flowing fluid through the bore of the first plug after the conical section of the releasable sealing member seats against the float collar.

* * * * *